US008393698B2

(12) United States Patent
Ichimura et al.

(10) Patent No.: US 8,393,698 B2
(45) Date of Patent: Mar. 12, 2013

(54) IMAGE FORMING APPARATUS AND FOAM APPLICATION DEVICE

(75) Inventors: Minori Ichimura, Tokyo (JP); Kazuyoshi Matsumoto, Tokyo (JP); Shinji Imoto, Tokyo (JP); Manabu Izumikawa, Tokyo (JP); Yasuhisa Kato, Kanagawa (JP); Yasuo Katano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 252 days.

(21) Appl. No.: 12/742,852

(22) PCT Filed: Dec. 4, 2008

(86) PCT No.: PCT/JP2008/072582

§ 371 (c)(1),
(2), (4) Date: May 13, 2010

(87) PCT Pub. No.: WO2009/075340

PCT Pub. Date: Jun. 18, 2009

(65) Prior Publication Data

US 2010/0245420 A1 Sep. 30, 2010

(30) Foreign Application Priority Data

Dec. 10, 2007 (JP) ..... 2007-318180

(51) Int. Cl.
*B41J 29/38* (2006.01)
*B41J 2/195* (2006.01)

(52) U.S. Cl. ..... 347/9; 347/6; 347/7

(58) Field of Classification Search ..... 347/6–7, 347/9; 118/100

See application file for complete search history.

(56) References Cited

U.S. PATENT DOCUMENTS

| | | | | |
|---|---|---|---|---|
| 2,971,458 | A * | 2/1961 | Kumins et al. | 101/170 |
| 4,552,778 | A * | 11/1985 | Zimmer | 427/445 |
| 4,620,983 | A * | 11/1986 | Zimmer | 427/8 |
| 5,771,054 | A | 6/1998 | Dudek et al. | |
| 6,183,079 | B1 | 2/2001 | Meade et al. | |
| 6,257,716 | B1 | 7/2001 | Yanagawa et al. | |
| 6,402,317 | B2 | 6/2002 | Yanagawa et al. | |

(Continued)

FOREIGN PATENT DOCUMENTS

| | | |
|---|---|---|
| JP | 59-69179 | 4/1984 |
| JP | 62-241572 | 10/1987 |

(Continued)

OTHER PUBLICATIONS

Apr. 17, 2012 Japanese official action in connection with a counterpart Japanese patent application.

*Primary Examiner* — Jason Uhlenhake
(74) *Attorney, Agent, or Firm* — Cooper & Dunham LLP

(57) ABSTRACT

A disclosed image forming apparatus comprises an image forming unit configured to form an image on a to-be-recorded medium, and a foam application unit configured to apply foam of at least one of a liquid and a gel to the to-be-recorded medium or an intermediate member. The intermediate member is configured to apply the foam to the to-be-recorded medium. The foam application unit includes a storage unit configured to store the foam and spread the foam in a width direction of the to-be-recorded medium or the intermediate member, an applicator configured to apply the foam to the to-be-recorded medium or the intermediate member, and a transport unit configured to transport the foam from the storage unit to the applicator.

9 Claims, 16 Drawing Sheets

U.S. PATENT DOCUMENTS

| | | | | |
|---|---|---|---|---|
| 6,431,670 | B1 * | 8/2002 | Schantz et al. | 347/7 |
| 6,439,713 | B1 | 8/2002 | Noguchi et al. | |
| 6,623,816 | B1 | 9/2003 | Tanikawa et al. | |
| 6,837,578 | B2 | 1/2005 | Tanikawa et al. | |
| 7,070,269 | B2 | 7/2006 | Tanikawa et al. | |
| 7,334,858 | B2 | 2/2008 | Kogure et al. | |
| 7,434,927 | B2 | 10/2008 | Sakuma et al. | |
| 7,621,632 | B2 | 11/2009 | Imoto et al. | |
| 7,682,016 | B2 | 3/2010 | Sakuma et al. | |
| 2006/0221153 | A1 * | 10/2006 | Kojima et al. | 347/86 |
| 2008/0106566 | A1 | 5/2008 | Kogure et al. | |

FOREIGN PATENT DOCUMENTS

| | | |
|---|---|---|
| JP | 1-164468 | 6/1989 |
| JP | 8-323977 | 12/1996 |
| JP | 2001-288737 | 10/2001 |
| JP | 2002-2889 | 1/2002 |
| JP | 2002-137378 | 5/2002 |
| JP | 2002-517341 | 6/2002 |
| JP | 2003-205673 | 7/2003 |
| JP | 2003-205999 | 7/2003 |
| JP | 2004-330569 | 11/2004 |
| JP | 2005-138502 | 6/2005 |

* cited by examiner

IMAGE FORMING APPARATUS AND FOAM APPLICATION DEVICE

TECHNICAL FIELD

The present invention relates to an image forming apparatus and a foam application device.

BACKGROUND ART

There are image forming apparatuses such as printers, facsimile machines, copying machines, plotters, and multifunction machines having function of these devices. Inkjet recording apparatuses are known as liquid ejection recording type image forming apparatuses that use a recording head for ejecting ink droplet. The liquid ejection recording type image forming apparatuses form an image on a sheet by ejecting ink droplets from a recording head onto the sheet being transported.

The image forming apparatuses of this type include serial type image forming apparatuses that form an image by ejecting liquid droplets from a recording head moving in a sub scanning direction and line type image forming apparatuses that form an image by ejecting liquid droplets from a stationary recording head.

The term "sheet" as used herein is not limited to paper but may be any substance, including OHP sheets, to which ink droplets or liquid can adhere. The "sheet" may also be referred to as a "to-be-recorded medium", a "recording medium", "recording paper", and a "recording sheet". The term "recording", "printing", and "imaging" may be used as synonyms for the term "image formation".

The term "image forming apparatus" as used herein indicates a device that forms images by ejecting liquid onto media such as paper, strings, fibers, cloth, leather, metal, plastic, glass, wood, and ceramics. The term "image formation" as used herein indicates not only forming images that have meanings, such as characters and figures, on a medium, but also forming images that do not have meanings, such as patterns, on a medium (i.e., merely ejecting liquid droplets onto a medium). The "ink" is not limited to liquid that is commonly called ink but may be any material that turns into liquid when ejected. For example, ink may include DNA samples, resist, and patterning materials.

These liquid ejection type image forming apparatuses form an image by ejecting ink containing color materials in the form of liquid droplets. Therefore, problems such as feathering, which refers to dots of liquid droplets spreading to produce a feather-like edge, and color bleeding, which refers to a blurred border between colors due to adjacent different color ink droplets on a sheet being mixed, may occur. Moreover, it takes time for liquid droplets on a sheet to dry after printing.

Japanese Patent Laid-Open Publication No. 8-323977 (Patent Document 1) discloses a technique to prevent blurring using a heating device before or after printing and quickly dry ink after printing.

Japanese Patent Laid-Open Publication No. 2002-137378 discloses a technique to prevent blurring by applying a pretreatment liquid that reacts with ink using an application roller. Japanese Patent Laid-Open Publication No. 2005-138502 discloses a technique to apply a pretreatment liquid by ejecting the pretreatment liquid in the form of mist.

However, providing a heating device as in Patent Document 1 results in increased power consumption. On the other hand, using an application roller or a liquid ejection head as in Patent Documents 2 and 3 causes uneven application of a pretreatment liquid. Further, since the pretreatment liquid is in liquid form and therefore does not dry quickly after reaction with ink on a sheet, the sheet tends to be curled or warped, which often results in jamming.

DISCLOSURE OF THE INVENTION

The present invention aims to evenly apply a liquid and/or a gel in foam form in uniform thickness.

According to an aspect of the present invention, there is provided an image forming apparatus that comprises an image forming unit configured to form an image on a to-be-recorded medium, and a foam application unit configured to apply foam of at least one of a liquid and a gel to the to-be-recorded medium or an intermediate member. The intermediate member is configured to apply the foam to the to-be-recorded medium. The foam application unit includes a storage unit configured to store the foam and spread the foam in a width direction of the to-be-recorded medium or the intermediate member, an applicator configured to apply the foam to the to-be-recorded medium or the intermediate member, and a transport unit configured to transport the foam from the storage unit to the applicator.

According to another aspect of the present invention, there is provided a foam application device that applies foam of at least one of a liquid and a gel to an application target member. The foam application device comprises a storage unit configured to store the foam and spread the foam in a width direction of the application target member, an applicator configured to apply the foam to the application target member, and a transport unit configured to transport the foam from the storage unit to the applicator.

The term "foam" (also referred to as a "foamy liquid" and a "foamy gel") as used herein indicates a liquid or gel in the form of foam, i.e., in a compressible state with a large amount of bubbles dispersed (a collection of small bubbles). The term "gel" as used herein indicates a semisolid material formed from a colloidal solution in which polymers are dispersed in a dispersion medium with independent mobility being lost due to interaction and are cross linked to form a net-like or honeycomb structure. The term "spreading" as used herein indicates extending and distributing.

The above-described image forming apparatus and the foam application device include a storage unit configured to store foam and spread the foam in a width direction of the application target member, an applicator configured to apply the foam to the application target member, and a transport unit configured to transport the foam from the storage unit to the applicator. Therefore, it is possible to evenly apply a liquid and/or a gel in foam form in the width direction of the application target member.

BEST MODE FOR CARRYING OUT THE INVENTION

Figure 1:
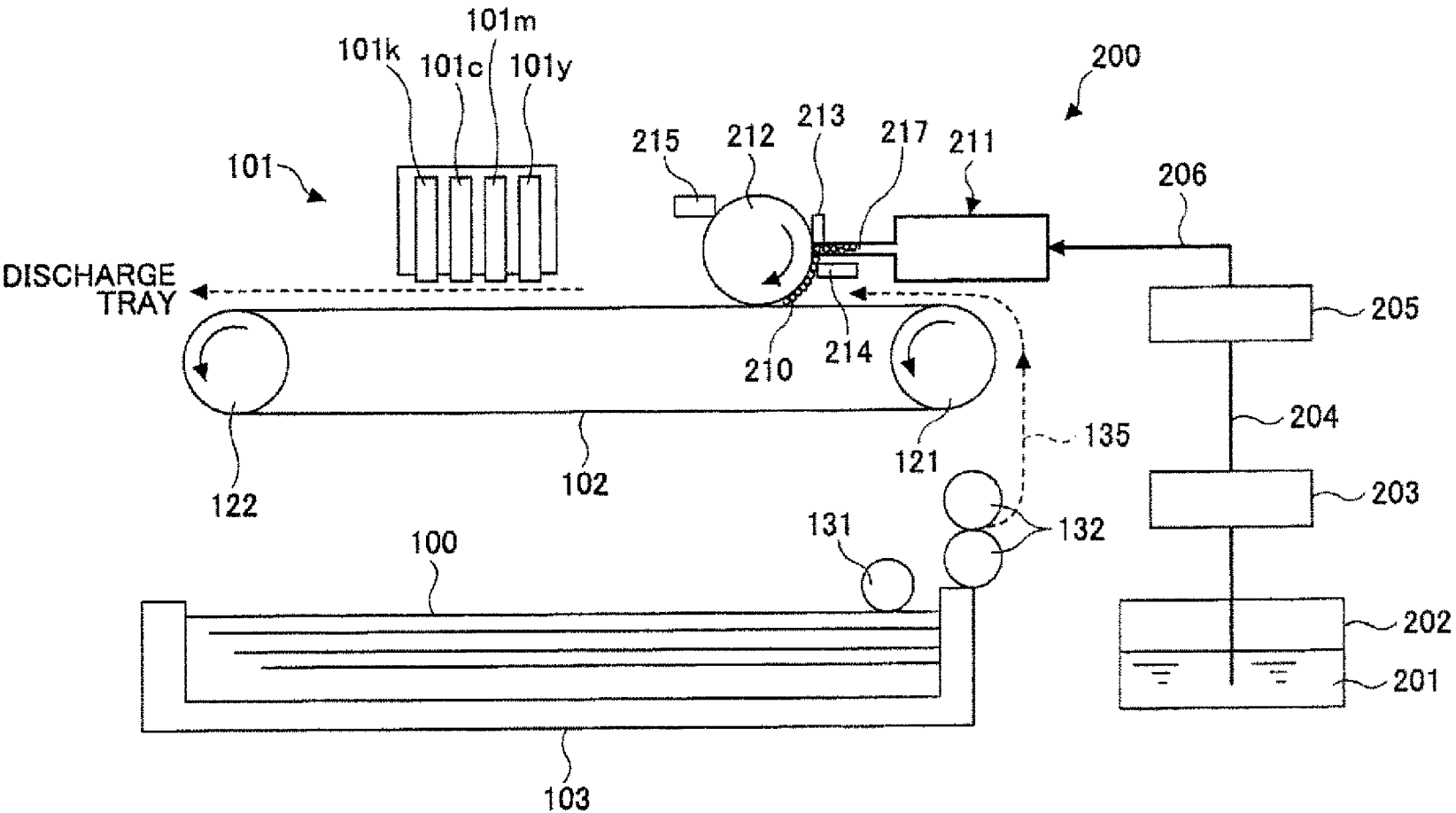
FIG. 1 is a diagram schematically illustrating the configuration of an image forming apparatus including a foam application device according to an embodiment of the present invention.

Exemplary embodiments of the present invention are described below with reference to the accompanying drawings. An example of an image forming apparatus including a foam application device according to a first embodiment of the present invention is described below with reference to FIG. 1. FIG. 1 is a diagram schematically illustrating the configuration of the image forming apparatus.

The image forming apparatus includes a recording head unit 101 as an image forming unit for ejecting liquid droplets onto a sheet 100 as a to-be-recorded medium to form an image, a transport belt 102 for transporting the sheet 100, a feed tray 103 for storing the sheets 100, and a foam application device (a device for applying foam to an application target member (i.e., a member to which foam is to be applied)) 200 disposed upstream of the recording head unit 101 in a sheet transport direction for applying a foamy liquid to the sheet 100 as an application target member.

The head unit 101 includes line type liquid ejection heads, namely, recording heads 101*y*, 101*m*, 101*c*, and 101*k* for ejecting ink droplets of yellow (Y), magenta (M), cyan (C), and black (K), respectively. Each liquid ejection head includes a nozzle array having a width corresponding to the sheet width. In an alternative embodiment, a serial type image forming apparatus may be used in which recording heads are mounted on a carriage.

The transport belt 102 is an endless belt extending around a transport roller 121 and a tension roller 122. The transport belt 102 may be configured to hold the sheet 100 using electrostatic attraction or attraction by air suction. Other well-known transport units may alternatively be used.

The sheets 100 stored in the feed tray 103 are separated and transported one by one by a pickup roller 131. The sheet 100 is then fed by a pair of transport rollers 132 and another pair of transport rollers (not shown) via a transport path 135 onto the transport belt 102, by which the sheet 100 is held.

The foam application device 200 applies foam 210 to the to-be-recorded medium 100 as an application target member being transported by the transport belt 102. The foam 210 applied to the sheet 100 dries quickly. The recording head unit 101 ejects liquid droplets of different colors onto the sheet 100 to form an image.

Then, the sheet 100 is discharged onto a discharge tray (not shown).

The foam application device 200 includes a container 202 for storing a liquid and/or gel 201 that can be converted into foam form (these liquids and gels are hereinafter referred to as a "treatment liquid" or a "setting agent"); a pump 203 for force-feeding the treatment liquid 201 from the container 202; a foam generating unit 205 for generating, from the treatment liquid 201 supplied by the pump 203 via a supply path 204, the foam 210 with small bubble diameter suitable for application; a storage unit 211 for storing the foam 210 supplied via a supply path 206 from the foam generating unit 205 and introduced from an inlet port (not shown) and spreading the foam 210 in the width direction of the to-be-recorded medium 100 (or an intermediate member); and an application roller 212 as an applicator for holding the foam 210, which is supplied from a supply port 217 of the storage unit 211, on its periphery and applying the foam 210 to the to-be-recorded medium 100.

The foam application device 200 further includes an opening and closing unit 213 for restricting the supply area of the foam 210 to the application roller 212; a thickness restricting member 214 for restricting the thickness (application layer thickness) of the foam 210 held by the application roller 212, and a cleaning unit 215 for removing the foam 210 remaining on the periphery of the application roller 212 after application.

The treatment liquid 201 that can be converted into foam form is a modifier that modifies the surface of the sheet 100 when applied to the surface of the sheet 100. The treatment liquid 201 is a fixing agent (setting agent) and is, for example, evenly applied to the sheet 100 (which may or may not be paper as mentioned above) in advance so as to cause the moisture of ink to penetrate into the sheet 100, increase the viscosity of color components, and promote quick drying, thereby preventing blurring (feathering, bleeding, etc.) and strike-through and improving the productivity (the number of image outputs per unit time).

The treatment liquid 201 may be a solution prepared by adding a base such as cellulose (hydroxypropylcellulose, etc.) and talc powder to, for example, a surfactant (which may be anionic, cationic, or nonionic, or may be a mixture of two or more of them). The treatment liquid 201 may also contain particles.

The foam 210 may preferably have a bubble content corresponding to a bulk density in the range from 0.01 g/cm$^3$ to 0.1 g/cm$^3$.

Applying the treatment liquid 201 in the form of the foam 210 containing a large amount of air to the sheet 100 allows application of the treatment liquid 201 in small amounts. This enables even application, promotes quick drying, and makes it possible to output a high quality image with no blurring, strike-through, and density variation.

That is, applying a treatment liquid in the form of foam has the following advantages (effects) over applying a treatment liquid in the form of liquid or mist.

(1) Since foam contains a large amount of air, it is possible to apply the treatment liquid in small amounts.

(2) Since foam is close to solid, it is possible to easily adjust the application layer thickness by shaving the foam off after application. Further, since foam is easily separated from an applicator when applied to a sheet from the applicator, it is possible to evenly apply the foam.

(3) Since applying a treatment liquid in the form of foam reduces the amount of moisture that penetrates into fibers of a sheet, it is possible to prevent the sheet from being rumpled or curled.

These advantages of foam application are independent from the types of treatment liquids, and similar effects are attained even if different types of treatment liquids are used. The treatment liquid may preferably have an effect of preventing generation of paper powder and may have an effect of changing the background color of a sheet.

In order to evenly apply foam to a to-be-recorded medium or an application target member, such as an intermediate member for applying the foam to a to-be-recorded medium, in the width direction, the foam needs to be sufficiently spread in the width direction before being applied. However, since foam is close to solid and therefore does not spread easily, it is difficult to spread the foam in the width direction of the to-be-recorded medium or the intermediate member by just transporting the generated foam.

Therefore, in an embodiment of the present invention, a transport unit for feeding the foam toward an applicator is provided in a storage unit for storing the foam and spreading the foam in the width direction of the application target member so that the storage unit spreads the foam in the width direction of the application target member while the transport unit feeds the foam.

Figure 2:
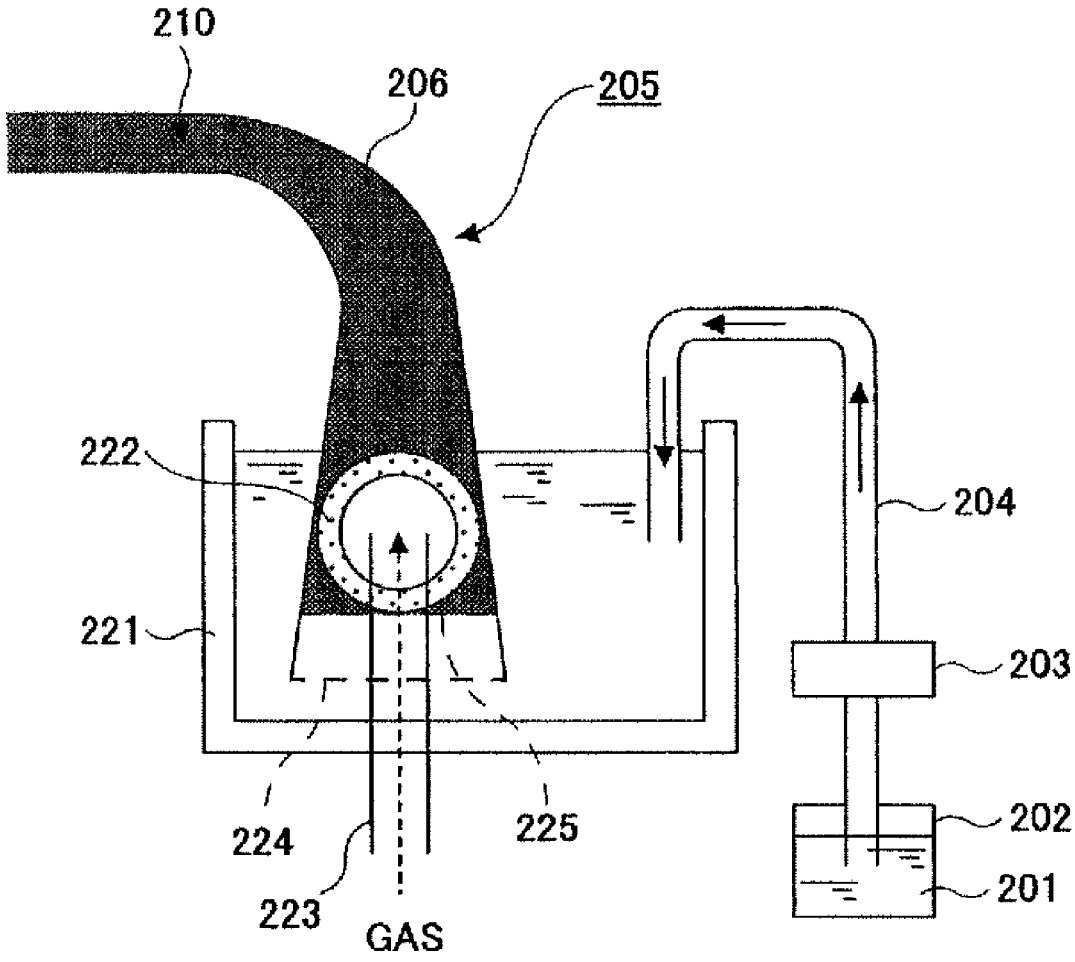
FIG. 2 is a diagram schematically illustrating an example of a foam generating unit of the foam application device.

An example of the foam generating unit 205 of the foam application device 200 is described below with reference to FIG. 2.

The foam generating unit 205 includes a container 221 for storing the foam 201 supplied from the container 202 by the pump 203, a cylindrical porous member 222 disposed in the container 221, and a gas supply unit 223 for supplying gas into the porous member 222. The gas supply unit 223 may be configured to feed air using a fan and duct, for example. An end of the supply path 206 surrounds the porous member 222 to prevent the generated foam 210 from being randomly distributed and to sufficiently supply the treatment liquid 201 to be converted into foam form to the porous member 222. A first slit 224 and a second slit 225 are formed in an inlet portion (a portion where the porous member 222 is disposed) of the supply path 206.

In this foam generating unit 205, when gas is supplied to the porous member 222, the foam 210 is generated from the treatment liquid 201. While gas is supplied to generate the foam 210, the generated foam 210 moves (i.e., is transported) inside the supply path 206 due to its accumulation force and thus is supplied to the storage unit 211. When the supplying of gas is stopped, the foam 210 does not accumulate and therefore is not transported. In this way, since the generated foam 210 is transported and supplied due to its accumulation force without using any special transport unit, the configuration is simplified.

Figure 3:
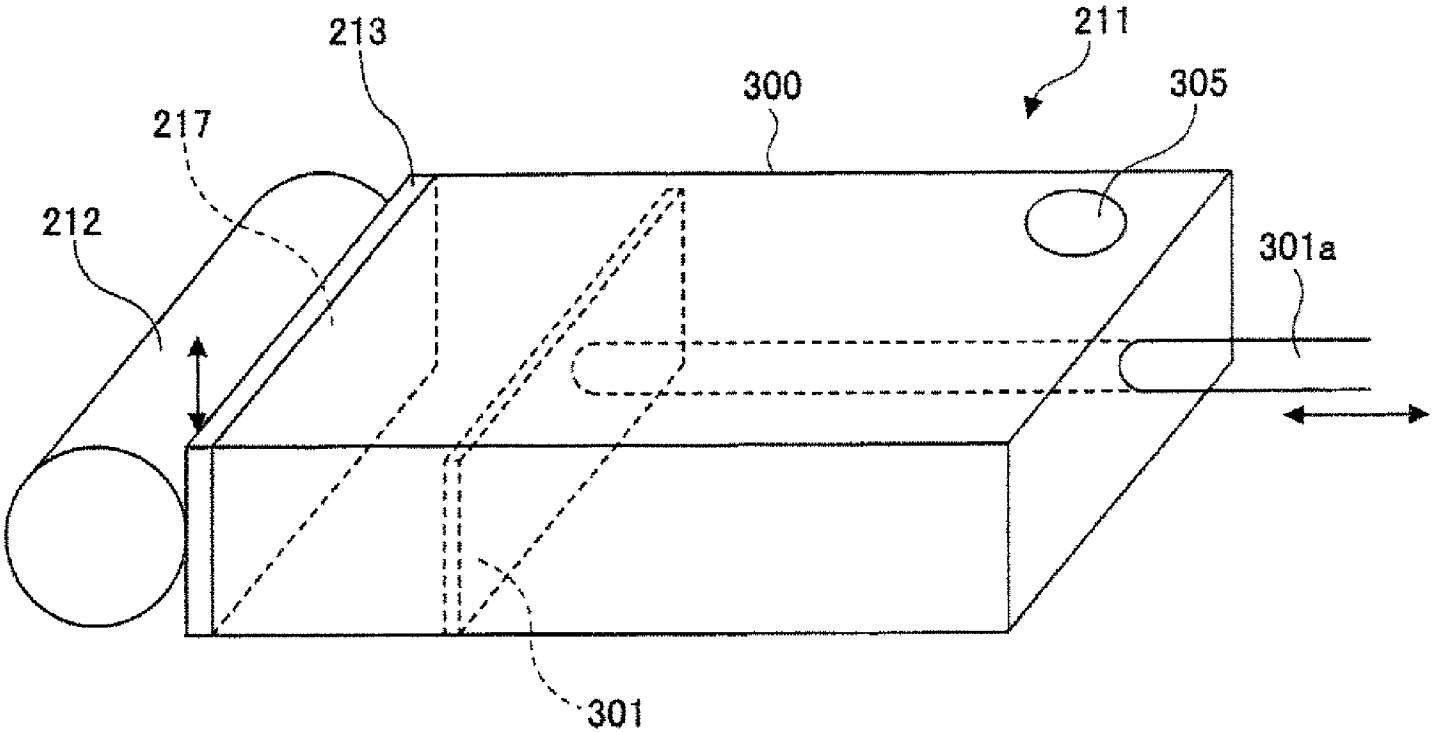
FIG. 3 is a perspective view schematically illustrating an example of a storage unit of the foam application device.

An example of the storage unit 211 of the foam application device 200 is described below with reference to FIG. 3. FIG. 3 is a perspective view schematically illustrating the storage unit 211.

In the storage unit 211, a transport wall 301 as a partition member is disposed inside a foam storage container 300. The transport wall 301 is movable toward and away from the supply port 217 opposing the application roller 212. The foam storage container 300 has an air exit 305 for allowing air to flow out of the foam storage container 300 when the foam 210 is introduced via a foam inlet port (not shown) from the supply path 206. The air exit 305 may preferably be made of a material that does not allow passage of foam and allows only passage of air.

In the storage unit 211, when the supply port 217 is closed with the opening and closing unit 213, the foam 210 is introduced into the foam storage container 300. Then, the transport wall 301 is moved toward the supply port 217 by operating an operating unit 301*a* from the outside, so that a force is applied to the foam 210 by the transport wall 301. Thus, the foam 210 spreads in the sheet width direction. The opening and closing unit 213 is opened at a predetermined timing, so that the foam 210 is applied to the application roller 212 across the sheet width direction.

Figure 4:
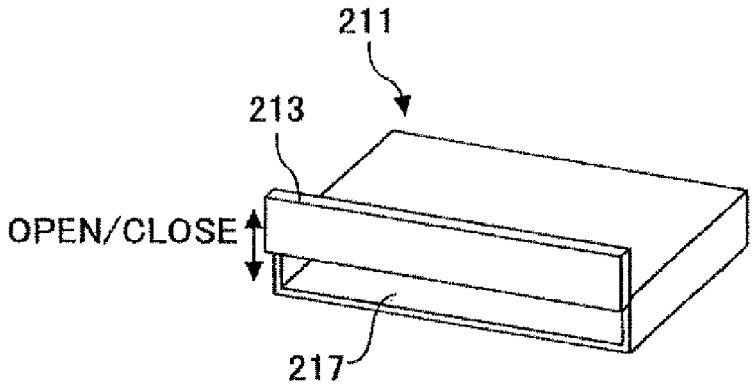
FIG. 4 is a perspective view schematically illustrating an example of an opening and closing unit of the foam application device.
Figure 5:
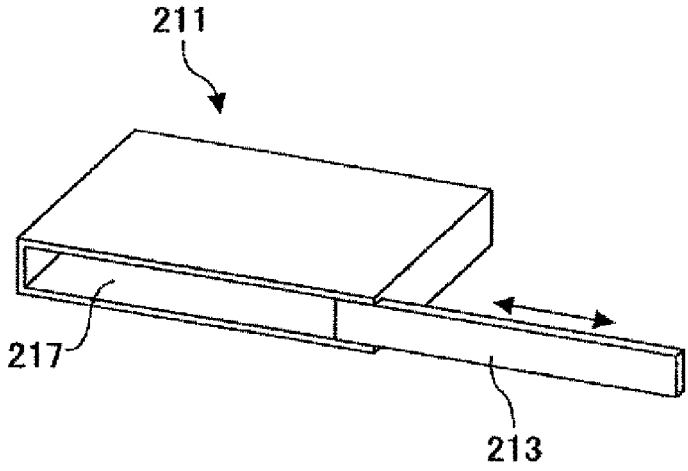
FIG. 5 is a perspective view schematically illustrating another example of an opening and closing unit.

Examples of the opening and closing unit 213 may include the one shown in FIG. 4, which moves up and down to open and close the supply port 217, and the one shown in FIG. 5, which moves a distance corresponding to the sheet width in the horizontal direction (corresponding to the sheet width direction).

If the configuration of the opening and closing unit 213 of FIG. 4 is employed, since it is possible to adjust the application area in the circumferential direction of the application roller 212, it is possible to control the application area of the sheet 100 in the transport direction. If the configuration of the opening and closing unit 213 of FIG. 5 is employed, since it is possible to adjust the application area in the circumferential direction and the axial direction of the application roller 212 by opening and closing the opening and closing unit 213, it is possible to control the application area of the sheet 100 in the width direction (i.e., the direction orthogonal to the transport direction) as well.

Figure 6:
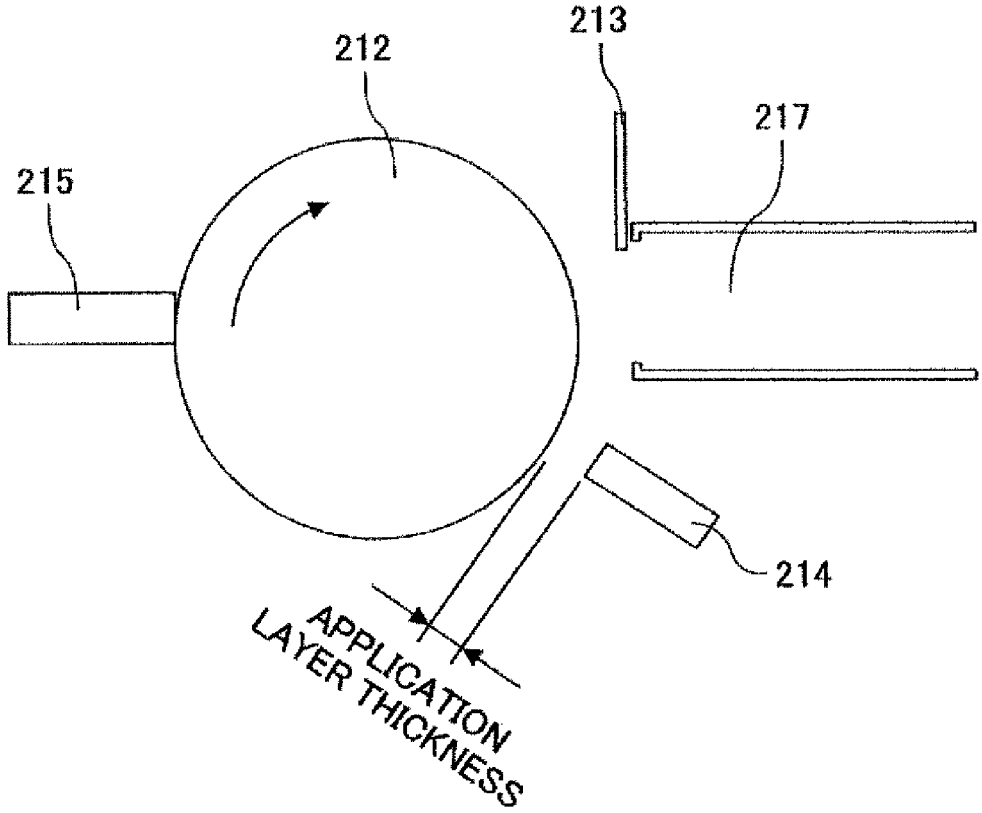
FIG. 6 is a diagram for explaining an application layer thickness.

Referring to FIG. 6, the thickness restricting member 214 can adjust the application layer thickness as desired by controlling the distance from the application roller 212. For example, the thickness restricting member 214 is moved by a drive unit (not shown) in the tangential or normal direction with respect to the periphery of the application roller 212 by performing a predetermined operation using an operations display unit 804 (described below) of the image forming apparatus, so that the application layer thickness can be adjusted. Thus, it is possible to set the application layer thickness of the foamy liquid to a desired value.

Figure 7:
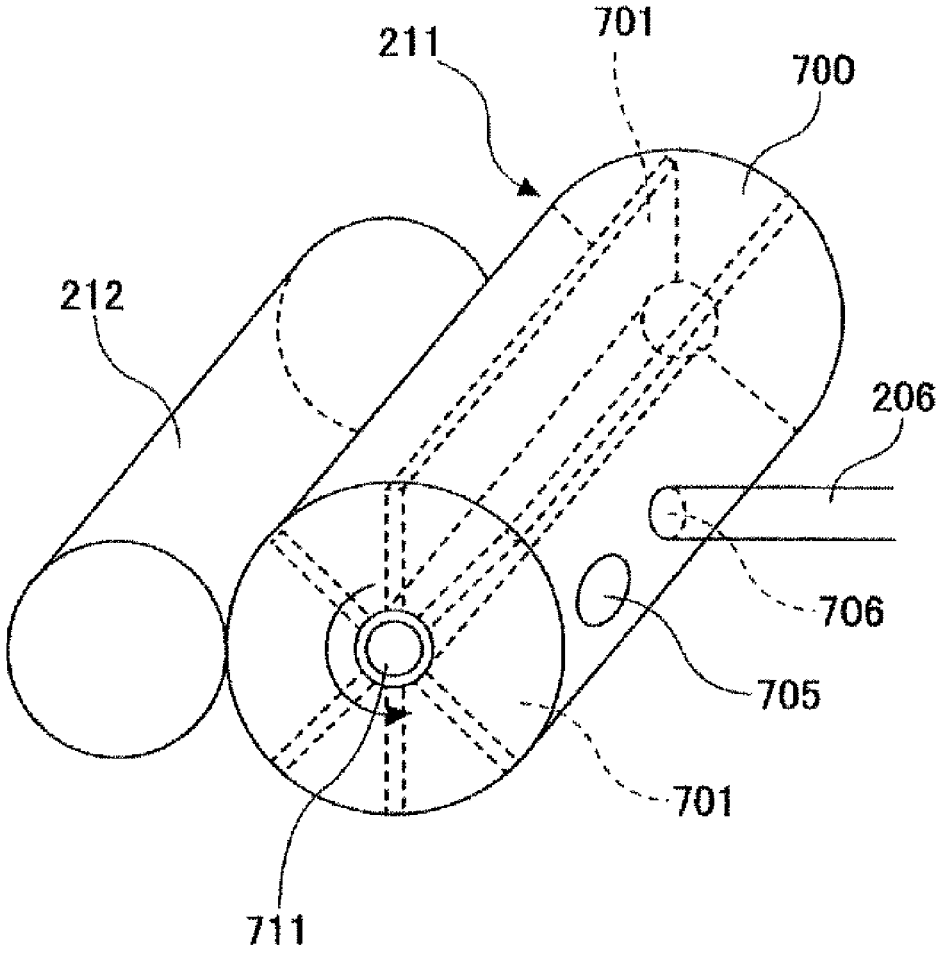
FIG. 7 is a perspective view schematically illustrating a storage unit of a foam application device according to a second embodiment of the present invention.

A foam application device of a second embodiment of the present invention is described below with reference to FIGS. 7 and 8. FIG. 7 is a perspective view schematically illustrating a storage unit 211 of the foam application device.

Figure 8:
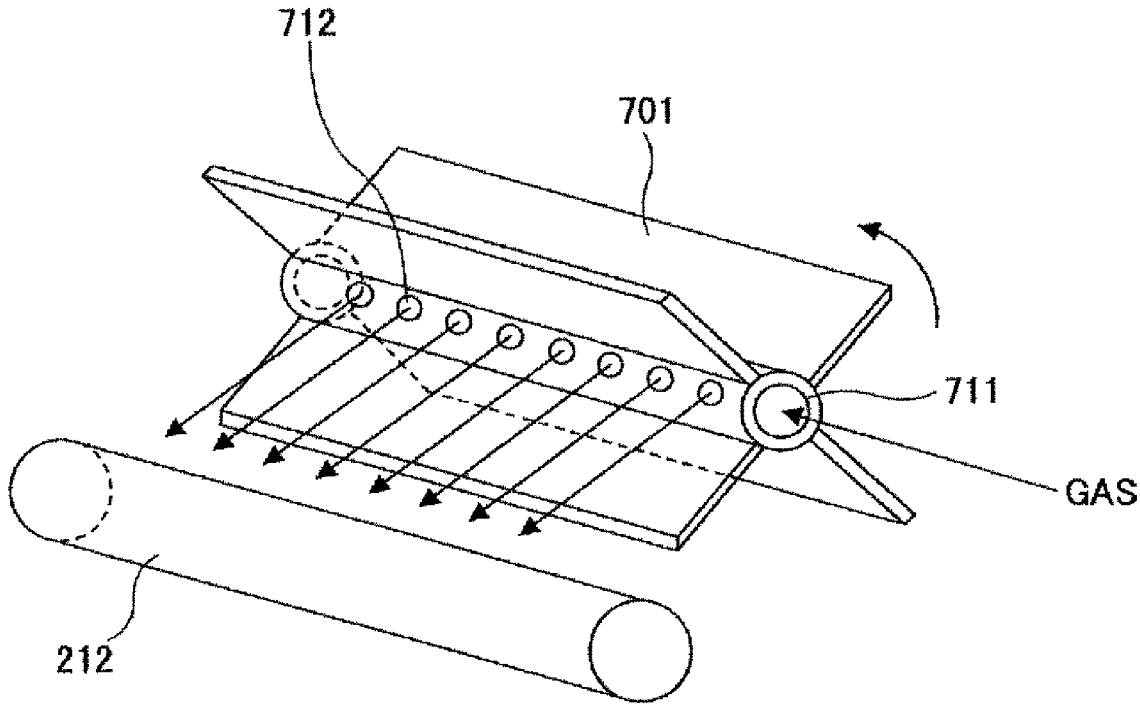
FIG. 8 is a perspective view schematically illustrating a part of the storage unit.

FIG. 8 is a diagram schematically illustrating a part of the storage unit 211.

In the storage unit 211, plural partition members (foam transport walls) 701 are arranged radially around a rotary shaft 711, which rotates in the direction of the arrow, to divide the space inside a cylindrical foam storage container 700 into plural storage spaces.

The partition members 701 are rotatable with the rotary shaft 711 (four partition members 701 are arranged in this example, although less than or more than four partition members may be arranged). The foam storage container 700 has an air exit 705 for allowing air to flow out of the foam storage container 700 when the foam 210 is introduced via an inlet port 706. The air exit 705 may preferably be made of a material that does not allow passage of foam and allows only passage of air.

As shown in FIG. 8, the rotary shaft 711 of the partition members 701 is formed of a hollow member having one closed end and one open end at the other side for introducing air. Plural outlet ports 712 that are opened and closed at predetermined timings are formed in the rotary shaft 711 in the axial direction.

In the storage unit 211, the foam 210 supplied via the supply path 206 from the foam generating unit 205 is introduced into the foam storage container 700 from the inlet port 706, so that the storage spaces separated by the plural partition members 701 are filled with the foam 210. Thus, the foam 210 spreads in the width direction of the to-be-recorded medium 100. When the rotary shaft 711 is rotated to rotate the partition members 701, the foam 210 is continuously transported and supplied from the supply port 217 to the application roller 212. Unlike the first embodiment, since there is no need to move back the transport wall 301 toward the foam inlet port, it is possible to continuously transport the foam 210 and easily respond to high-speed printing.

The supply port 217 of the foam storage container 700 may have the form of a net to make the foam 210 finer when supplied.

The foam 210 is supplied from the supply port 217 of the foam storage container 700 to the application roller 212 in the following manner. Referring to FIG. 8, the outlet ports 712 of the rotary shaft 711 are opened and closed at predetermined timings such that when the transported foam 210 reaches a predetermined position, gas is fed into the rotary shaft 711. Thus, the foam 210 is forced out toward and is supplied to the application roller 212 due to the force of the gas flowing out of the outlet ports 712.

Figure 9:
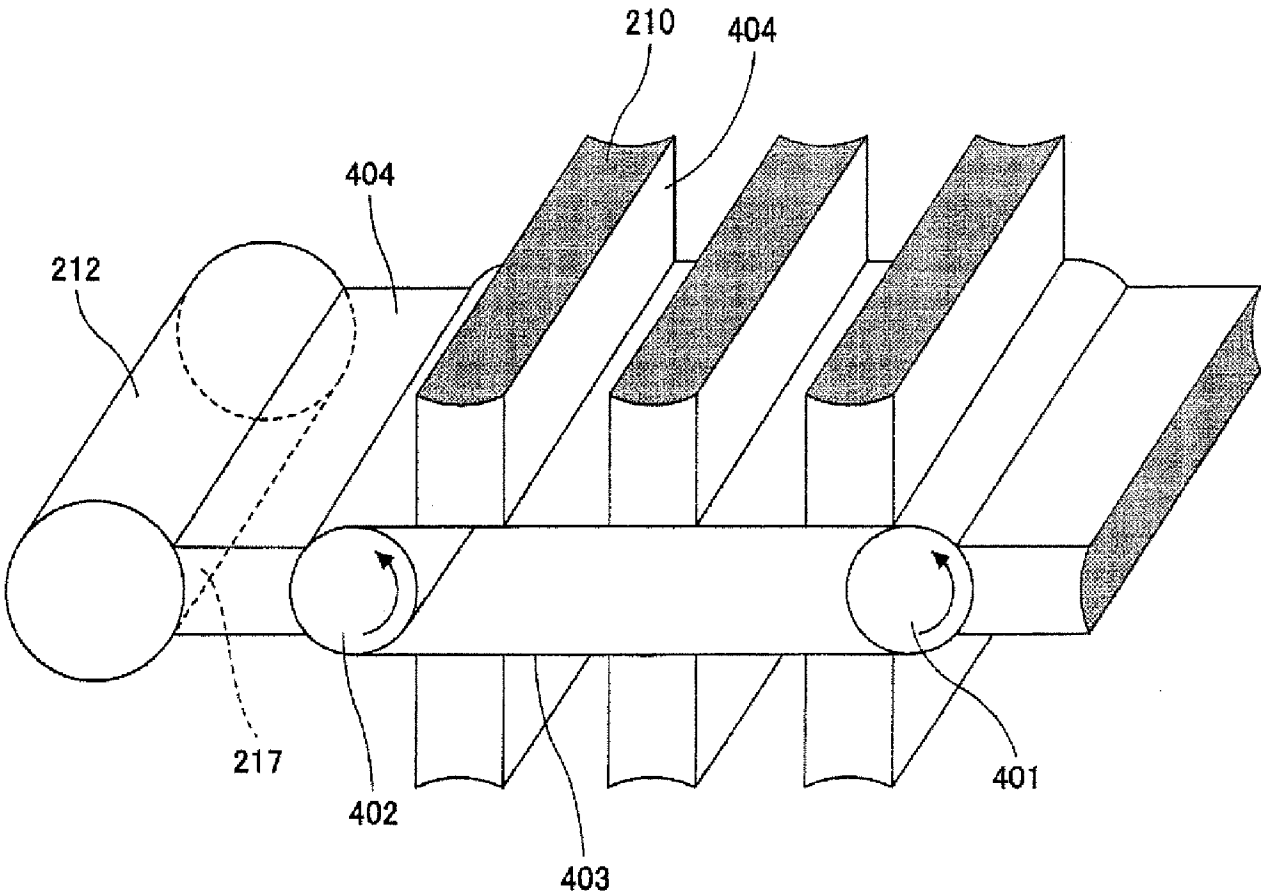
FIG. 9 is a perspective view schematically illustrating a storage unit of a foam application device according to a third embodiment of the present invention.

A foam application device of a third embodiment of the present invention is described below with reference to FIG. 9. FIG. 9 is a perspective view schematically illustrating a storage unit of the foam application device.

According to this embodiment, spreading members 404 are provided on the surface of an endless belt 403 extending around and rotated by rollers 401 and 402 that rotate in the direction of the arrows. Each spreading member 404 is formed of one or more flexible members and is configured to spread the foam 210 in the sheet width direction by filling the flexible members with the foam 210.

Figure 10:
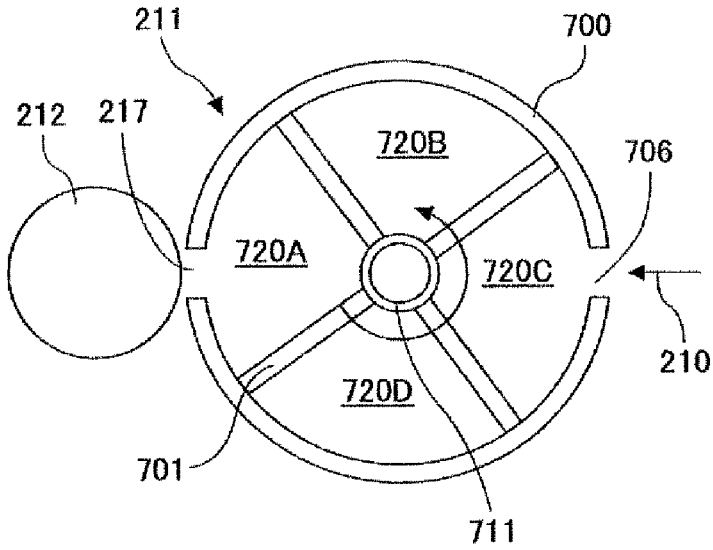
FIG. 10 is a diagram schematically illustrating a storage unit of a foam application device according to a fourth embodiment of the present invention.

A foam application device of a fourth embodiment of the present invention is described below with reference to FIG. 10. FIG. 10 is a diagram schematically illustrating a storage unit of the foam application device.

According to this embodiment, each of four storage spaces 720A through 720D (also referred to as spaces 720) separated by the partition members 701 of the second embodiment has a storage capacity for storing an amount of the foam 210 that can be applied at a time to the entire printing area of the sheet 100. This makes it possible to continuously apply the foam 210 by supplying the foam 210, for example, from the storage space 720A to the first page, from the storage space 720B to the second page, from the storage space 730C to the third page, and so on. Thus, filling the storage unit 211 with the foam 210 is performed according to print data, which can reduce loss of filling time and waste of the foam 210.

Figure 11:
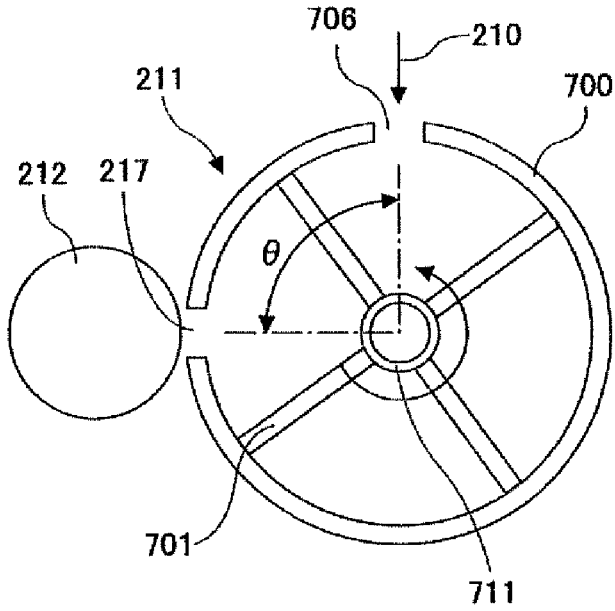
FIG. 11 is a diagram schematically illustrating a storage unit of a foam application device according to a fifth embodiment of the present invention.

A foam application device of a fifth embodiment of the present invention is described below with reference to FIG. 11. FIG. 11 is a diagram schematically illustrating a storage unit of the foam application device.

According to this embodiment, the inlet port 706 through which the foam 210 is introduced into the foam storage container 700 and the supply port 217 through which the foam 210 is supplied to the application roller 212 are arranged to satisfy a relationship: $\theta \geqq 360°/n$ where $\theta$ represents the angle between the inlet port 706 and the supply port 217 in the rotational direction of the partition members 701 and n represents the number of the partition members 701.

In this example, since four storage spaces 720 (four partition members 701) are provided, the angle $\theta$ is 90° or greater in order to efficiently store and transport the foam 210. This is because if the angle $\theta$ between the inlet port 706 and the supply port 217 is less than 360/4=90°, each storage space 720 reaches the supply port 217 to the application roller 212 before the storage space 720 is filled with the foam 210, which results in reduced foam transporting efficiency.

Figure 12:
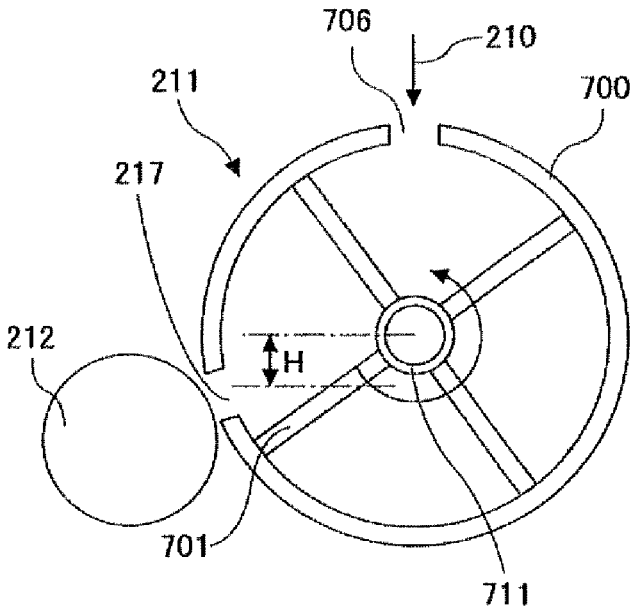
FIG. 12 is a diagram schematically illustrating a storage unit of a foam application device according to a sixth embodiment of the present invention.

A foam application device of a sixth embodiment of the present invention is described below with reference to FIG. 12. FIG. 12 is a diagram schematically illustrating a storage unit of the foam application device.

According to this embodiment, the center of the supply port 217 of the foam storage container 700 to the application roller 212 is located vertically below (located a height H below) the center of the foam storage container 700. With this configuration, upon supplying the foam 210 from the supply port 217 to the application roller 212, since the weight of the foam 210 acts on the application roller 212, the force of the gas flowing out of the outlet ports 712 of the rotary shaft 711 can be reduced by an amount corresponding to the component of the gravitational force of the foam 210 in the direction of the force of the gas.

That is, the energy for feeding the gas into the rotary shaft 711 of the storage unit 211 can be reduced. For example, in the case of feeding air into the rotary shaft 711 using a fan, the drive current of the fan can be reduced, so that power consumption can be reduced compared with the case where center of the supply port 217 to the application roller 212 is located vertically at the same level as the center of the foam storage container 700.

Figure 13:
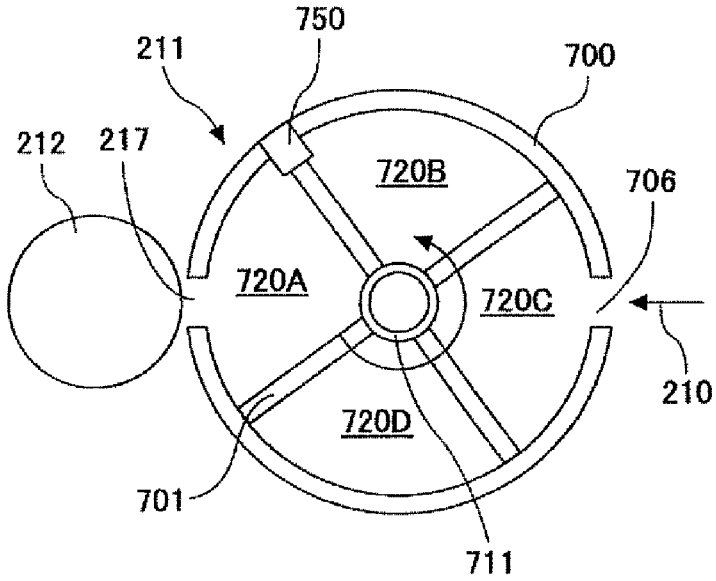
FIG. 13 is a diagram schematically illustrating a storage unit of a foam application device according to a seventh embodiment of the present invention.

A foam application device of a seventh embodiment of the present invention is described below with reference to FIG. 13. FIG. 13 is a diagram schematically illustrating a storage unit of the foam application device.

According to this embodiment, at least the side surface of the foam storage container 700 is formed of a permeable member, and a foam amount detecting unit 750 is located vertically above the center of the supply port 217 to the application roller 212 on the side surface. The foam amount detecting unit 750 detects whether the amount of the foam 210 stored in the storage space 720 is equal to or greater than a predetermined amount. Thus, it is possible to detect an error in foam supply from the foam generating unit 205 to the storage unit 211.

Figure 14:
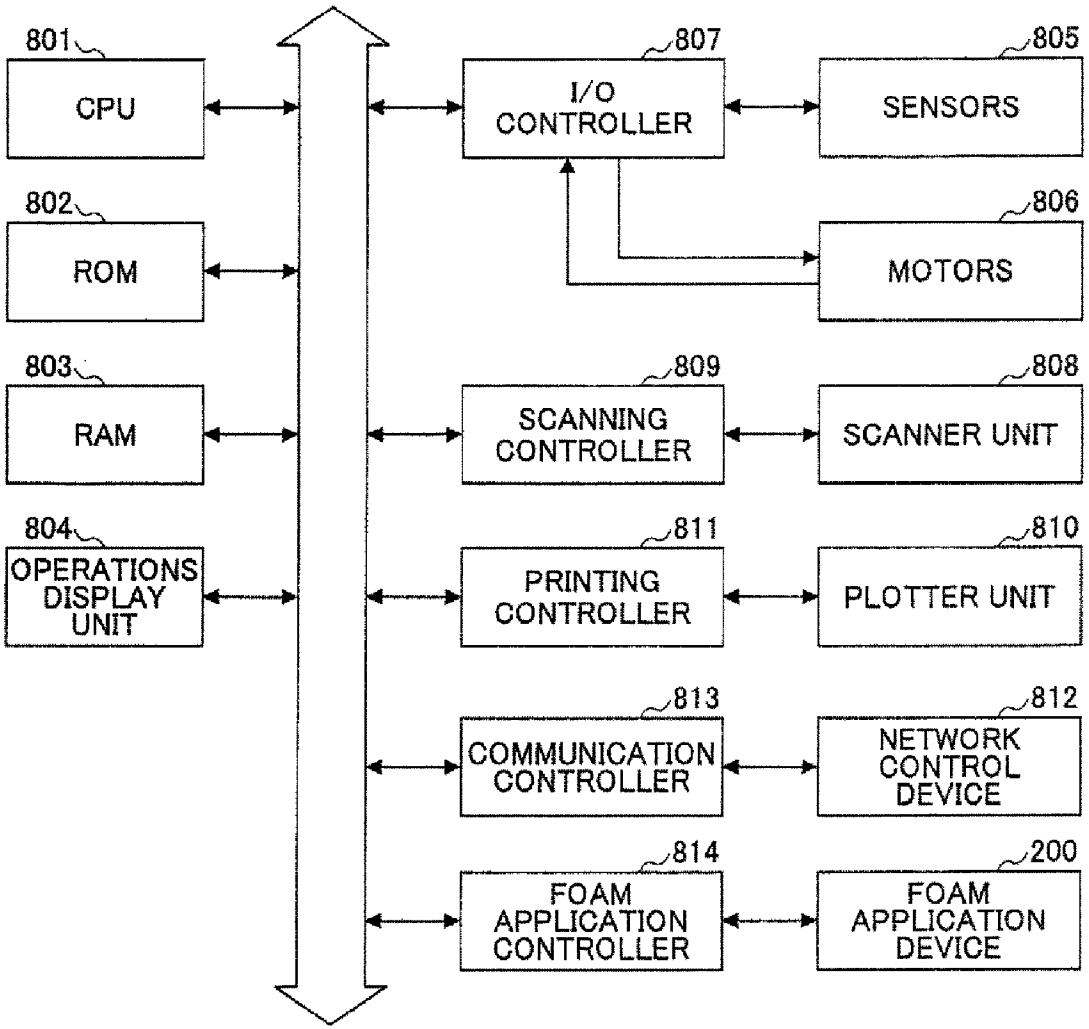
FIG. 14 is a functional block diagram illustrating a control unit of the image forming apparatus.

An overview of a control unit of the image forming apparatus is described below with reference to the block diagram of FIG. 14.

The control unit includes a CPU 801 for controlling the system of the image forming apparatus, a ROM 802 for storing information such as programs executed by the CPU 801, a RAM 803 as a work area, the operations display unit 804 to be used by an operator to specify various settings, various sensors 805 for detecting the sheet size, jams, etc., various motors 806, an input/output (I/O) controller 807 for outputting control signals to the sensors 805 and the motors 806, a scanning controller 809 for controlling an image scanning unit (scanner unit) 808, a printing controller 811 for controlling a plotter unit (printing mechanism unit) 810, a communication controller 813 for performing various control operations of facsimile communications including control operations of a network control device 812 which performs interface (I/F) control operations with telephone lines, and a foam application controller 814 for controlling the foam application device 200.

The sensors 805 include a liquid end detecting unit (not shown) for detecting whether the treatment liquid 201 is stored in the container 202 and the foam amount detecting unit 750 of the storage unit 211. The motors 806 include a motor (not shown) for rotating the rotary shaft 711 of the partition members 701 which transport the foam 210 in the storage unit 211 and motors (not shown) for rotating the application roller 212, the opening and closing unit 213, the thickness restricting member 214, the transport roller 121, the pair of transport rollers 132, and the pickup roller 131.

An example of a print operation performed by the image forming apparatus is described below with reference to the flowcharts of FIGS. 15 through 17. In the following example, the partition members 701 are provided in the storage unit 211 of the cylindrical foam storage container 700 as in the second embodiment.

Figure 15:
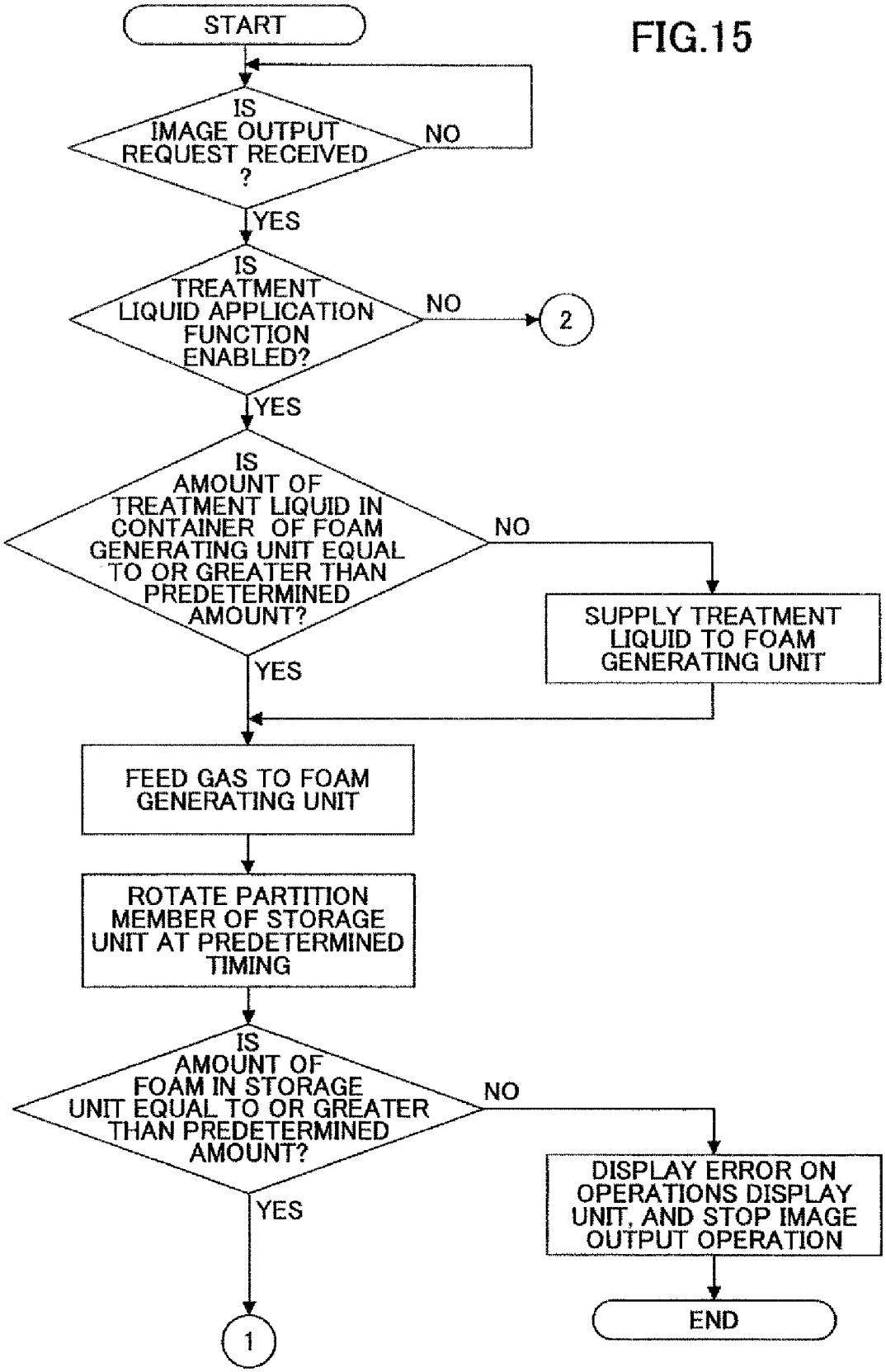
FIGS. 15 through 17 are flowcharts illustrating a print operation performed by the control unit.

Referring to FIG. 15, if an image output request is received, it is determined whether a treatment liquid (setting agent) application function is enabled. If the treatment liquid application function is enabled, it is determined whether the amount of the treatment liquid 201 stored in the container 221 of the foam generating unit 205 is equal to or greater than a predetermined amount. If the amount of the treatment liquid 201 stored in the container 221 of the foam generating unit 205 is less than the predetermined amount, the pump 203 is driven to supply the treatment liquid 201 from the container 202 to the container 221 of the foam generating unit 205 and, after that, gas is fed to the foam generating unit 205. On the other hand, if the amount of the treatment liquid 201 stored in the container 221 is equal to or greater than the predetermined amount, the procedure directly proceeds to the step where gas is fed to the foam generating unit 205. Then, formation of the foam 210 is started, and the partition members 701 of the storage unit 211 are rotated at a predetermined timing.

Then, the foam amount detecting unit 750 determines whether the amount of the foam 210 stored in the storage unit 211 is equal to or greater than a predetermined amount, for example, an amount required for application to the entire printing area of the sheet (to-be-recorded medium) 100 to be printed. If the foam 210 stored in the storage unit 211 is less than the predetermined amount, an error is displayed on the operations display unit 804, and an image output operation is stopped. On the other hand, if the foam 210 stored in the storage unit 211 is equal to or greater than the predetermined amount, the procedure proceeds to the process shown in FIG. 16.

Figure 16:
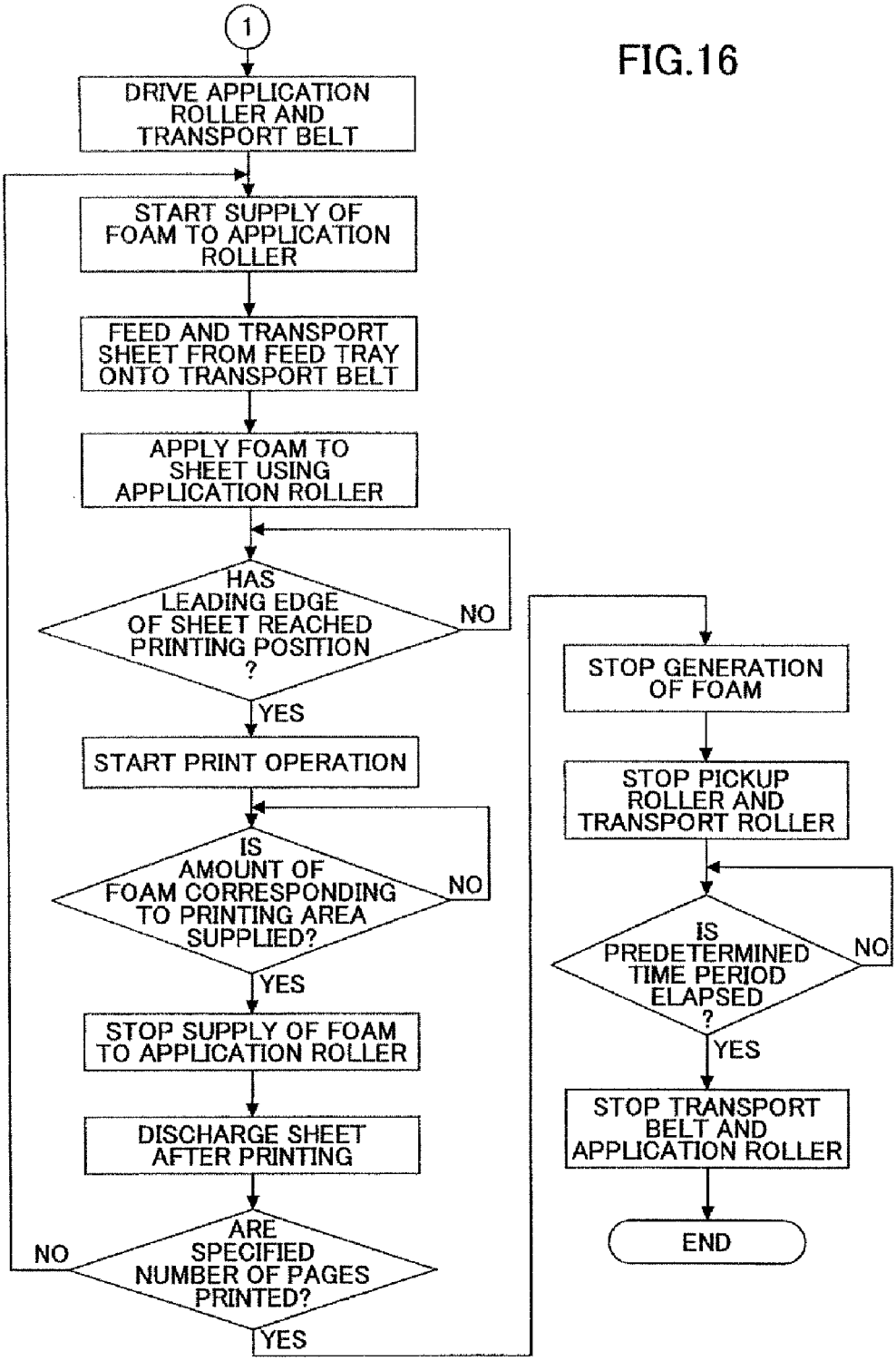
Figure 17:
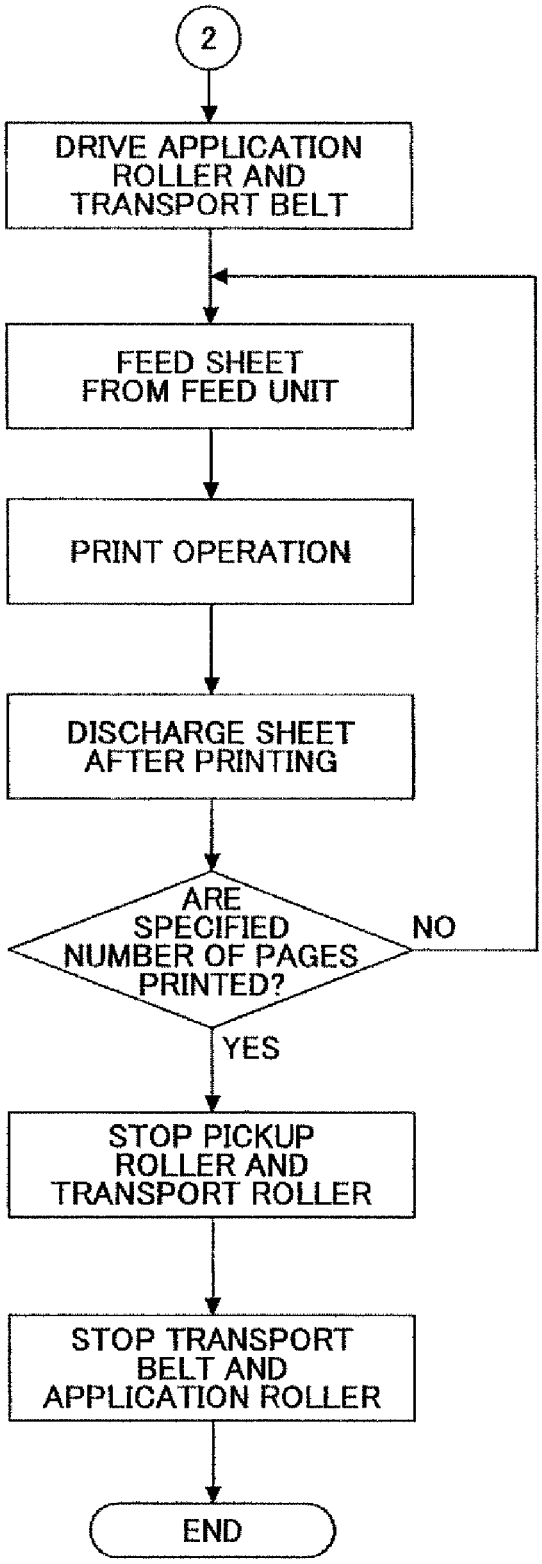

Referring to FIG. 16, the application roller 212 and the transport belt 102 are driven.

Then, the opening and closing unit 213 is opened at a predetermined timing and, at the same time, gas is fed into the rotary shaft 711 of the partition members 701 of the storage unit 211. Thus, as described above, supply of the foam 210 to the surface of the application roller 212 is started. Then, the foam 210 is held on the surface of the application roller 212. The foam 210 held on the surface of the application roller 212 is adjusted to a predetermined thickness by the thickness restricting member 214. Then, the foam 210 is transported toward the transport belt 102.

Then, the to-be-recorded medium (sheet) 100 is fed and transported from a feed unit (the feed tray 103) onto the transport belt 102. The foam 210 is applied to the to-be-recorded medium 100 by the application roller 212. When the leading edge of the to-be-recorded medium 100 reaches a printing position of the recording head unit 101, a print operation is started. When an amount of the foam 210 corresponding to the printing area of the sheet 100 to the application roller 212 is supplied, the opening and closing unit 213 of the storage unit 211 is closed to stop supplying the foam 210 to the application roller 212. Feeding gas to the rotary shaft 711 is also stopped.

After discharging the to-be-recorded medium 100 with an image formed, the process starting from the step of feeding the sheet 100 is repeated until a specified number of pages are printed. When the specified number of pages are printed, feeding gas to the foam generating unit 205 is stopped to stop generation of the foam 210. Then, the pickup roller 131 and the pair of transport rollers 132 are stopped. After the elapse of a predetermined time period, i.e., a time period long enough to complete cleaning of the application roller 212, the transport belt 102 and the application roller 212 are stopped.

In the case where, for example, a special to-be-recorded medium is to be used and therefore there is no need to apply the foam 210, the treatment liquid application function is disabled in FIG. 15. If the treatment liquid application function is disabled, the procedure proceeds to the process shown in FIG. 17. Then, the application roller 212 and the transport belt 102 are driven, and the to-be-recorded medium 100 is fed from the feed unit. After printing is performed on the to-be-recorded medium using the recording head unit 101, the to-be-recorded medium 100 is discharged. When a specified number of pages are printed, the pickup roller 131 and the pair of transport rollers 132 are stopped. After the elapse of a predetermined time period, the transport belt 102 and the application roller 212 are stopped.

The reason for the application roller 212 being rotated as well during the predetermined time period is that, since the gap between the application roller 212 and the transport belt 102 is, at maximum, equal to the sheet thickness+the layer thickness or less, the application roller 212 may otherwise interfere with transporting the to-be-recorded medium 100.

In the above embodiments, the foam application device applies the foam 210 to the sheet 100 before image formation. In an alternative embodiment, the foam application device may be disposed downstream of the recording head unit 101 so that the foam 210 is applied to the sheet 100 after image formation. Further, in the above embodiments, the foam 210 is generated from a liquid that can be converted into foam form and is applied. However, the present invention is applicable to a device that generates foam from a gel that can be converted into foam form and applies the generated foam, and an image forming apparatus including this device.

The foam application device of any of the above embodiments is also applicable to electrophotographic image forming apparatuses, for example. For example, the foam application device of any of the above embodiments is applicable to a fixing method, a fixing device, an image forming method, and an image forming apparatus that applies a foamy fixing liquid to a medium such as paper to which particles containing resin such as toner particles adhere without disturbing the resin particles on the medium to quickly fix the resin particles onto the medium. The foamy fixing liquid used here is one that can be applied in small amounts to prevent oil from remaining on the medium.

Figure 18A:
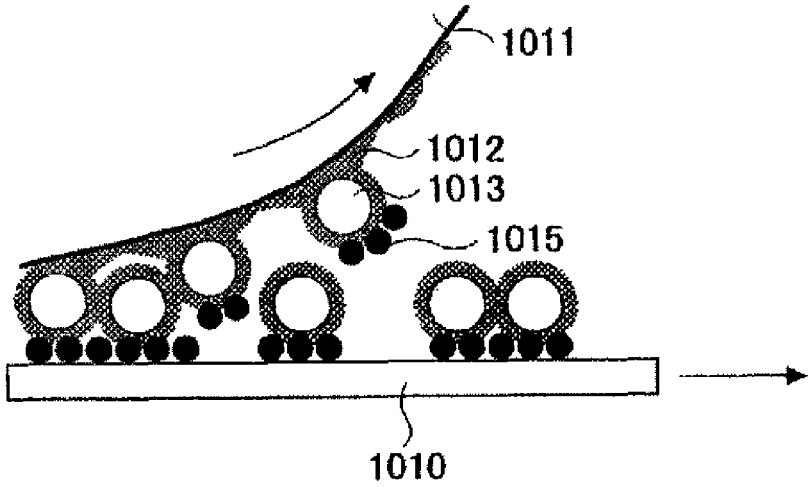
FIGS. 18A and 18B are enlarged views each illustrating, in an example in which a foam application device is applied to an electrophotographic image forming apparatus, an area where a roller application surface is in contact with unfixed resin particles in the case where a force applied to the contact surface between an application roller and a recording medium is relatively large.
Figure 18B:
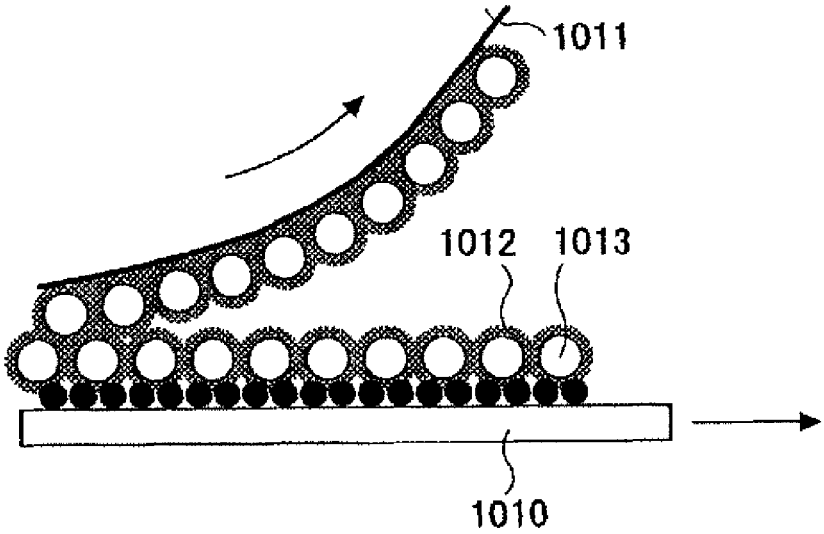
Figure 19A:
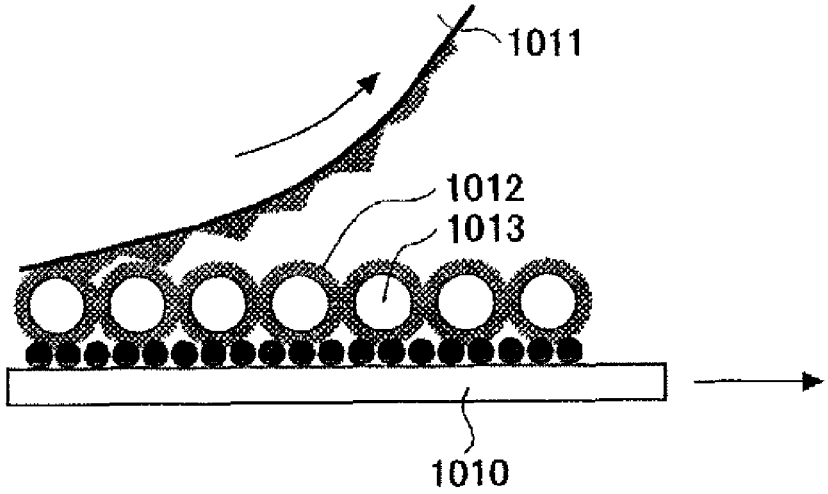
FIGS. 19A and 19B are enlarged views each illustrating an area where a roller application surface is in contact with unfixed resin particles in the case where a force applied to the contact surface between an application roller and a recording medium is relatively small.
Figure 19B:
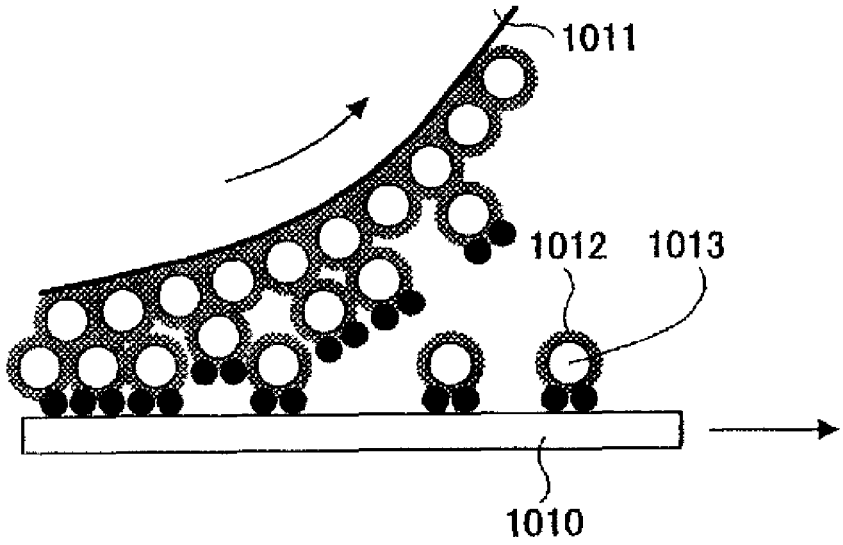

An example in which a foam application device of an embodiment of the present invention is applied to an electrophotographic image forming apparatus is described below with reference to FIGS. 18A through 19B. FIGS. 18A through 19B are enlarged views each illustrating an area where the roller application surface is in contact with unfixed resin particles. FIGS. 18A and 18B show the case where a force applied to the contact surface between an application roller 1011 and a recording medium 1010 is relatively large. On the other hand, FIGS. 19A and 19B show the case where a force applied to the contact surface between the application roller 1011 and the recording medium 1010 is relatively small. The rotational direction of the application roller 1011 and the moving direction of the recording medium 1010 as an application target member are indicated by the corresponding arrows in the drawings.

First, the case is discussed where a force applied to the contact surface between the application roller 1011 and the recording medium 1010 is relatively large. In the example shown in FIG. 18A, a foamy fixing liquid 1012 applied to the application surface of the application roller 1011 has a structure comprising a single layer of bubbles 1013. The bubbles 1013 of FIG. 18A through FIG. 19B have the same diameter, and therefore the layer thickness of the foamy fixing liquid 1012 of FIG. 18A can be less than that of FIG. 18B. In the example of FIG. 18A, however, since the bubbles 1013 are in a single layer, the bubbles 1013 tend to adhere to the application surface of the application roller 1011 due to surface tension. Therefore, the foamy fixing liquid 1012 is unevenly applied to a layer of resin particles (unfixed toner) 1015 on the recording medium 1010, so that some of the resin particles 1015 adhere to the bubbles 1013 remaining on the application surface of the application roller 1011, resulting in offset (transfer of toner particles) to the application surface of the application roller 1011.

On the other hand, in the example of FIG. 18B in which the foamy fixing liquid 1012 on the application surface of the application roller 1011 has a structure comprising multiple bubble layers, it is possible to embed the bubbles 1013 into the irregular surface of the unfixed toner 1015, and therefore the layers of the bubbles 1013 of the foamy fixing liquid 1012 are easily separated from each other. Thus, it is possible to apply the foamy fixing liquid 1012 evenly to the toner layer and substantially reduce toner offset.

That is, in the case where a force applied to the contact surface between the application roller 1011 and the recording medium 1010 is relatively large, in order to prevent the unfixed toner 1015 from offsetting to the application roller 1011, the average size of bubbles 1013 to be generated is calculated in advance, and the thickness of the foamy fixing liquid layer to be formed on the application roller 1011 is controlled to correspond to the thickness of multiple bubble layers such that multiple bubble layers are formed. Then, a foamy fixing liquid layer comprising multiple bubble layers is formed on the application roller 1011, which makes it possible to prevent toner offset.

Next, the case is discussed where a force applied to the contact surface between the application roller 1011 and the recording medium 1010 is relatively small. In the example shown in FIG. 19A, since the foamy fixing liquid 1012 applied to the application surface of the application roller 1011 has a structure comprising a single layer of bubbles 1013, the bubbles 1013 tend to adhere to the irregular application surface of the unfixed toner 1015. Therefore, the bubble layer is separated from the surface of the application roller 1011, so that the foamy fixing liquid 1012 is applied to the unfixed toner 1015.

On the other hand, in the example of FIG. 19B in which the foamy fixing liquid 1012 on the application surface of the application roller 1011 has a structure comprising multiple bubble layers, the bubbles 1013 are tightly linked together and therefore tend to remain on the application roller 1011, so that some of the resin particles 1015 adhere to the bubbles 1013 remaining on the application roller 1011, resulting in offset to the surface of the application roller 1011.

That is, in the case where a force applied to the contact surface between the application roller 1011 and the recording medium 1010 is relatively small, the average size of bubbles 1013 to be generated is calculated in advance, and the thickness of the foamy fixing liquid layer to be formed on the application roller surface is controlled to have a single bubble layer. Then, a foamy fixing liquid comprising a single bubble layer is formed on the application roller 1011, which makes it possible to prevent toner offset under the conditions where a small force is applied. If the bubble layer on the application roller 1011 is too thick, the bubble layer flows in the contact portion between the application roller 1011 and the recording medium 1010, so that the toner particles are carried by the flow, which results image deletion. Therefore, in order to prevent the unfixed toner 1015 from offsetting to the application roller 1011, it is preferable to control the thickness of the foamy fixing liquid layer to not impart fluidity.

By controlling the size of the bubbles 1013 to be contained in the foamy fixing liquid 1012 and the thickness of the fixing liquid layer based on the force to be applied, it is possible to prevent toner offset to a contact applicator such as an application roller and image deletion and to fix resin particles by applying a very small amount of the foamy fixing liquid 1012.

In an embodiment of the present invention, a softener for softening resin particles by dissolving or swelling at least a part of the resin particles is used, and a fixing liquid is applied to the resin particles on a medium using a contact applicator. The fixing liquid is in foam form containing bubbles when applied to the particles on the medium, and the thickness of the fixing liquid layer is controlled based on the force to be applied. Thus, it is possible to prevent toner offset to a contact applicator such as an application roller and image deletion and to fix the resin particles by applying a very small amount of the foamy fixing liquid. The effects on toner particles used for electrophotographic techniques as resin particles are great, and it is possible to prevent offset and image deletion by controlling the thickness of the fixing liquid layer based on the thickness of the layer of the resin particles.

The present application is based on Japanese Priority Application No. 2007-318180 filed on Dec. 10, 2007, with the Japanese Patent Office, the entire contents of which are hereby incorporated by reference.

The invention claimed is:

1. An image forming apparatus, comprising:

an image forming unit configured to form an image on a to-be-recorded medium; and a foam application unit configured to apply foam of at least one of a liquid and a gel to the to-be-recorded medium or an intermediate member, the intermediate member being configured to apply the foam to the to-be-recorded medium;

wherein the foam application unit includes a storage unit configured to store the foam and spread the foam in a width direction of the to-be-recorded medium or the intermediate member, an applicator configured to apply the foam to the to-be-recorded medium or the intermediate member, and a transport unit configured to transport the foam from the storage unit to the applicator, and wherein the transport unit includes plural partition members that are rotatably disposed and are configured to divide a cylindrical storage container of the storage unit into plural storage spaces, and the transport unit transports the foam toward the applicator by rotation of the partition members.

2. The image forming apparatus as claimed in claim 1, wherein each of the storage spaces separated by the plural partition members has a storage capacity for storing an amount of the foam that can be applied at a time to the entire area of the to-be-recorded medium.

3. The image forming apparatus as claimed in claim 2, wherein an inlet port through which the foam is introduced into the storage container and a supply port through which the foam is supplied to the applicator have a relationship represented by $\theta \geqq 360°/n$ where $\theta$represents an angle between the inlet port and the supply port in a rotational direction of the partition members and n represents the number of the partition members.

4. The image forming apparatus as claimed in claim 3, wherein a center of the supply port is located below a center of the storage container.

5. The image forming apparatus as claimed in claim 1, further comprising:

a foam storage amount detecting unit configured to detect whether an amount of the foam stored in the storage unit is equal to or greater than a predetermined amount.

6. The image forming apparatus as claimed in claim 1, wherein the storage unit spreads the foam in the width direction within the storage unit, before the foam is applied by the applicator.

7. The image forming apparatus as claimed in claim 1, wherein the storage unit spreads the foam in the width direction within the storage unit while the transport unit feeds the foam.

8. The image forming apparatus as claimed in claim 1, wherein the storage unit includes a supply port through which the foam is supplied to the applicator, and the transport unit includes a transport wall and an operating unit that is configured to move the transport wall towards the supply port to apply a force to the foam to spread the foam in the width direction.

9. A foam application device that applies foam of at least one of a liquid and a gel to an application target member, the foam application device comprising:

a storage unit configured to store the foam and spread the foam in a width direction of the application target member;

an applicator configured to apply the foam to the application target member; and a transport unit configured to transport the foam stored in the storage unit to the applicator, wherein the transport unit includes plural partition members that are rotatably disposed and are configured to divide a cylindrical storage container of the storage unit into plural storage spaces, and the transport unit transports the foam rd the applicator by rotation f the partition members.

* * * * *